US005778556A

United States Patent [19]

Ohsugi

[11] Patent Number: 5,778,556

[45] Date of Patent: Jul. 14, 1998

[54] DRYING EQUIPMENT

[75] Inventor: Yasuhiro Ohsugi, Hiroshima, Japan

[73] Assignee: NKG Co., Ltd., Hiroshima, Japan

[21] Appl. No.: 771,933

[22] Filed: Dec. 23, 1996

[30] Foreign Application Priority Data

Feb. 15, 1996 [JP] Japan ..... 8-028309

[51] Int. Cl.[6] ..... F26B 25/00

[52] U.S. Cl. ..... 34/106; 211/34

[58] Field of Search ..... 34/102, 103, 104, 34/106, 437, 440, 442; D32/58, 59; 211/34, 35, 37, 38; 12/129.4; 248/339, 340

[56] References Cited

U.S. PATENT DOCUMENTS

| | | | |
|---|---|---|---|
| 2,943,899 | 7/1960 | Beller | 312/3 |
| 3,669,276 | 6/1972 | Woods | 211/34 |
| 4,200,993 | 5/1980 | Blanc et al. | 34/104 |
| 4,727,656 | 3/1988 | Jannach et al. | 34/104 |
| 5,118,176 | 6/1992 | Motley, Sr. | 211/34 |
| 5,662,301 | 9/1997 | Fard | 211/34 X |

FOREIGN PATENT DOCUMENTS

| | | |
|---|---|---|
| 405192495 | 9/1993 | Japan . |
| 408117487 | 5/1996 | Japan . |
| 408173691 | 7/1996 | Japan . |

*Primary Examiner*—Henry A. Bennett
*Assistant Examiner*—Steve Gravini

[57] ABSTRACT

Drying equipment of this invention includes hanger parts each provided rotatably toward and away from a body in a range for positioning the tip portion thereof higher than the bottom portion thereof. When the drying equipment is in use, a suspending part disposed at the upper end of the body is used so as to spread the hanger parts, and when out of use, the body is hung upside down by using another suspending part disposed at the lower end of the body so as to automatically fold the hanger parts, resulting in requiring a compact space for storage.

7 Claims, 16 Drawing Sheets

DRYING EQUIPMENT

BACKGROUND OF THE INVENTION

1. Field of the Invention

The present invention chiefly relates to equipment for drying sports shoes such as sneakers.

2. Description of Related Art

Various types of drying equipment for sneakers and the like have been conventionally proposed, but most of them have a fixed structure. Therefore, they are bulky and require a large space when not used. Although some of them are fabricated, it is disadvantageously complicated to assemble and break up them.

SUMMARY OF THE INVENTION

The present invention was devised in view of the aforementioned circumstances. The object is providing drying equipment whose hanger parts can be folded in a compact size when the drying equipment is not used, which can be easily and rapidly spread by one hand for the usage of the drying equipment and can be dealt with very easily, and on which a plurality of pairs of shoes and the like can be hung and dried without a hitch.

The drying equipment of this invention comprises a body in a plate-like shape; a plurality of hanger parts each of which is pivoted on a surface of the body at a bottom portion thereof so as to be rotated toward and away from the body in a range for positioning its tip portion higher than its bottom portion; and a suspending part disposed at a higher end of the body.

Accordingly, the hanger parts can be rotated toward and away from the body in the predetermined range. Therefore, when the drying equipment is used, the respective hanger parts can be spread in the both sideward directions from the body, and when the drying equipment is not used, the hanger parts are folded to lie along the body, resulting in a compact form easily stored.

In one aspect of the drying equipment, the body includes a plurality of hitching portions on which strings are hung.

Accordingly, shoe strings and other small articles can be hung and dried on the respective plural hitching portions formed on the body.

In another aspect of the drying equipment, the body includes another suspending part at its lower end.

Accordingly, since the suspending part is also provided at the lower end of the body, the body can be hung upside down when not used. Thus, the hanger parts can be easily folded, resulting in easing the storage.

In still another aspect of the drying equipment, the hanger parts are provided on two faces of the body.

Accordingly, by using the hanger parts on the both faces of the body, a plurality of pairs of sneakers and the like can be dried simultaneously without a hitch.

In still another aspect of the drying equipment, the positions of the hanger parts on one face of the body are vertically shifted from those on the other face.

Accordingly, since the positions of the hanger parts on the two faces of the body are thus shifted in a direction higher and lower, each of the hanger parts can be easily mounted on the body, and the drying equipment can attain better airing, resulting in rapid drying.

In still another aspect of the drying equipment, the suspending parts includes a fixed clasping member linked with the top of the body for clasping an object on which the drying equipment is hung; and a movable clasping member axially supported on the fixed clasping member.

In still another aspect of the drying equipment, each of the fixed clasping member and the movable clasping member includes a clasping portion for clasping the object and a grip used for a clasping operation, and the grip of the movable clasping member extends in a direction crossing to the grip of the fixed clasping member and works also as a hook.

Accordingly, the drying equipment can be hung on a clothes-drying bar or the like by using the suspending part including the fixed clasping member and the movable clasping member. In addition, by using the movable clasping member, the drying equipment can be hung on an object on which the drying equipment is difficult to be hung by clasping.

The above and further objects and features of the invention will more fully be apparent from the following detailed description with accompanying drawings.

DETAILED DESCRIPTION OF THE INVENTION

The present invention will now be described by way of examples with reference to the accompanying drawings.

Figure 1:
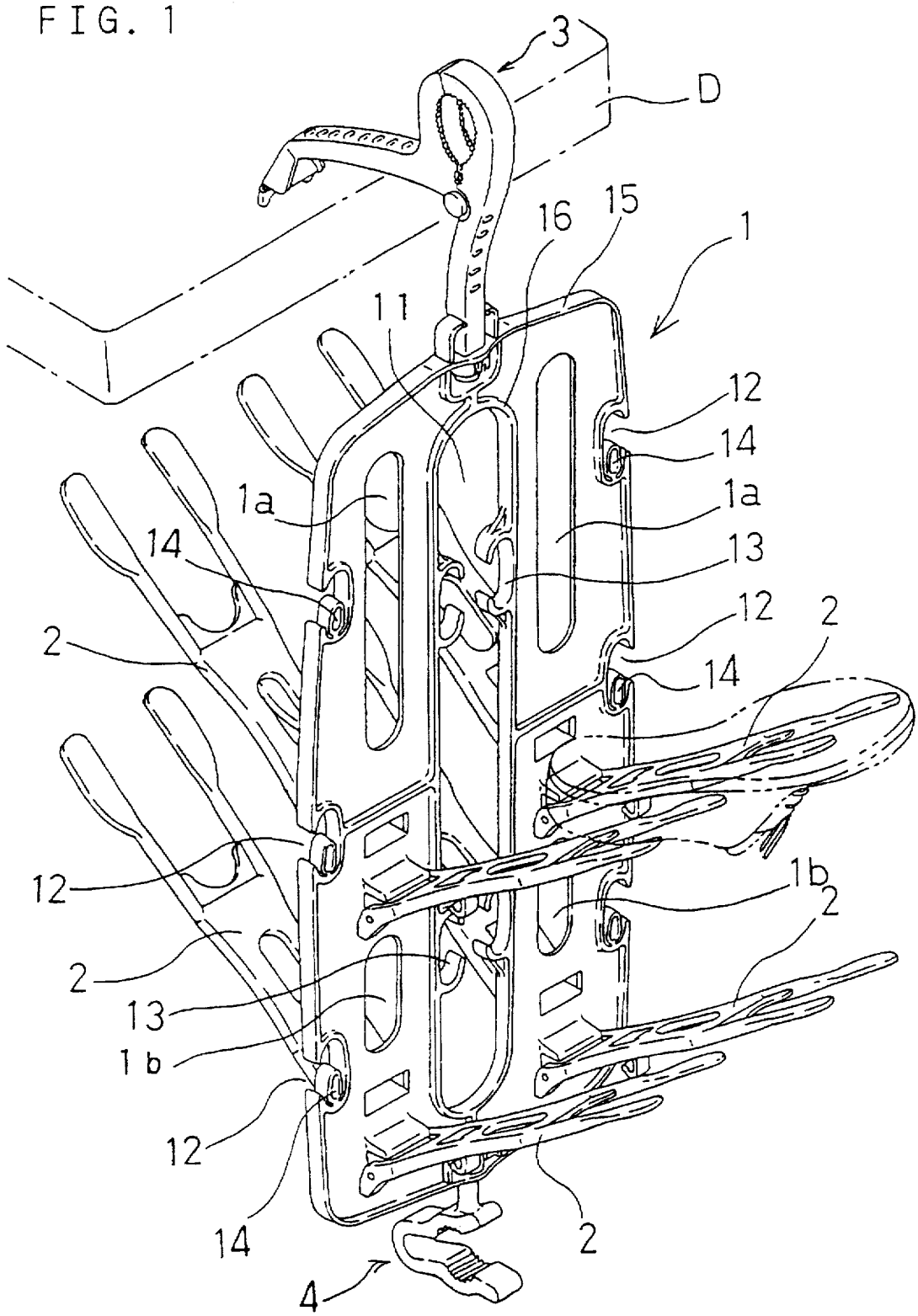
FIG. 1 is a perspective view of drying equipment of this invention in use.
Figure 2:
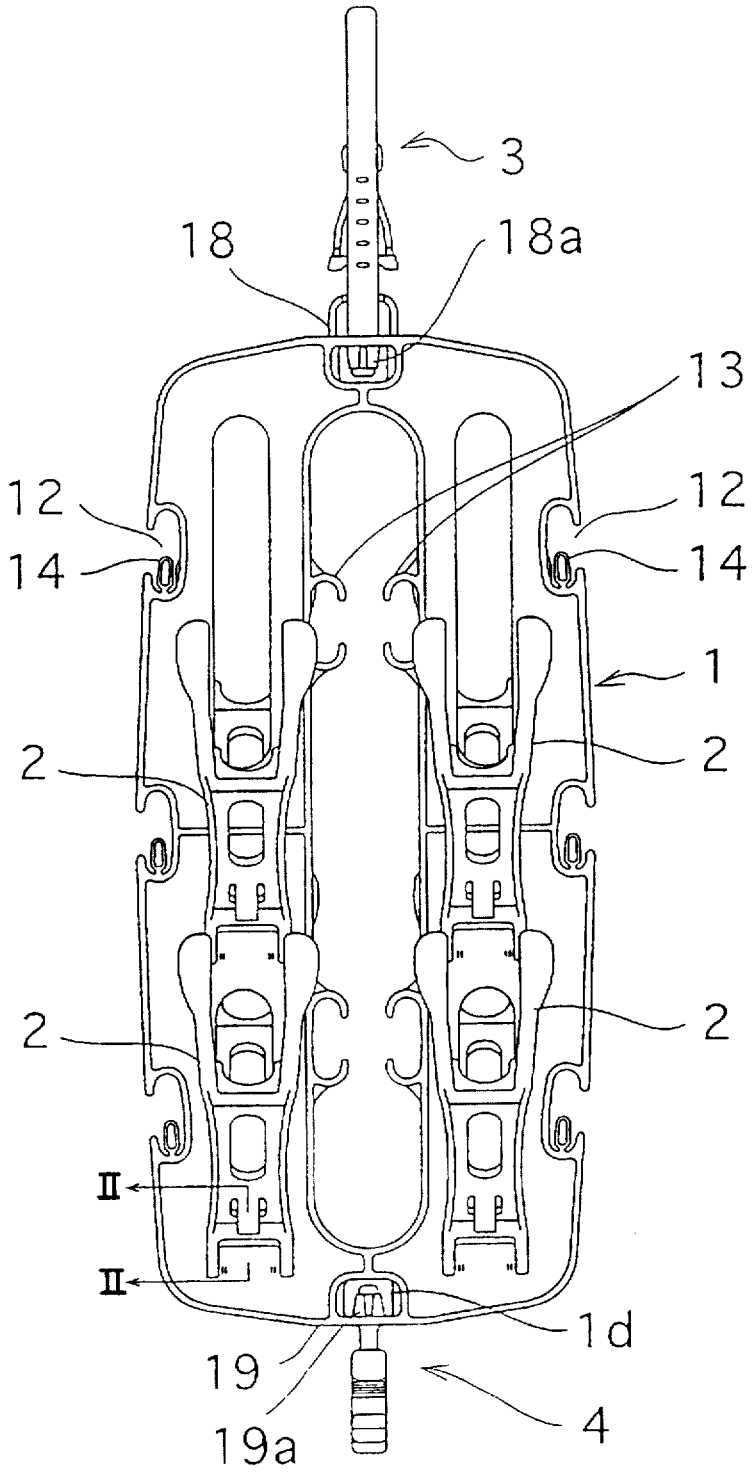
FIG. 2 is a front view of the drying equipment of FIG. 1 in use.
Figure 3:
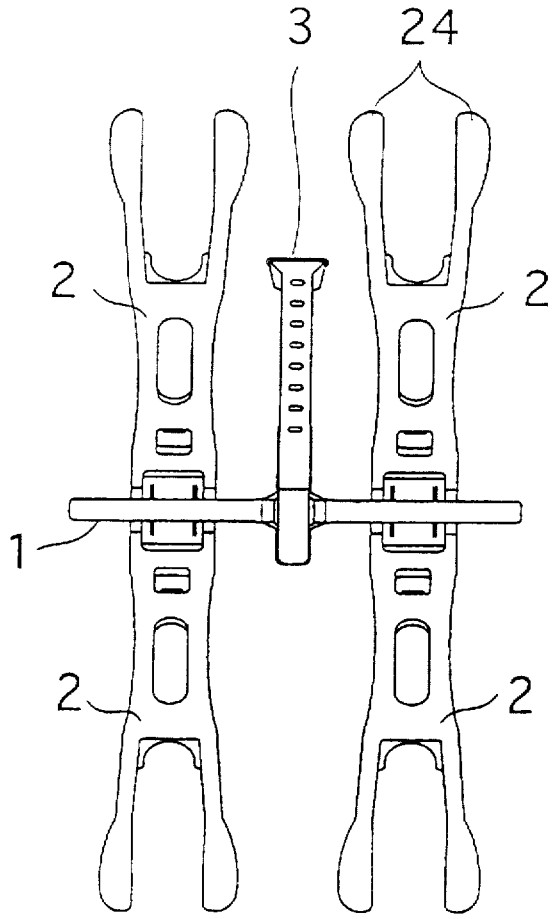
FIG. 3 is a plan view of the drying equipment of FIG. 1 in use.
Figure 4:
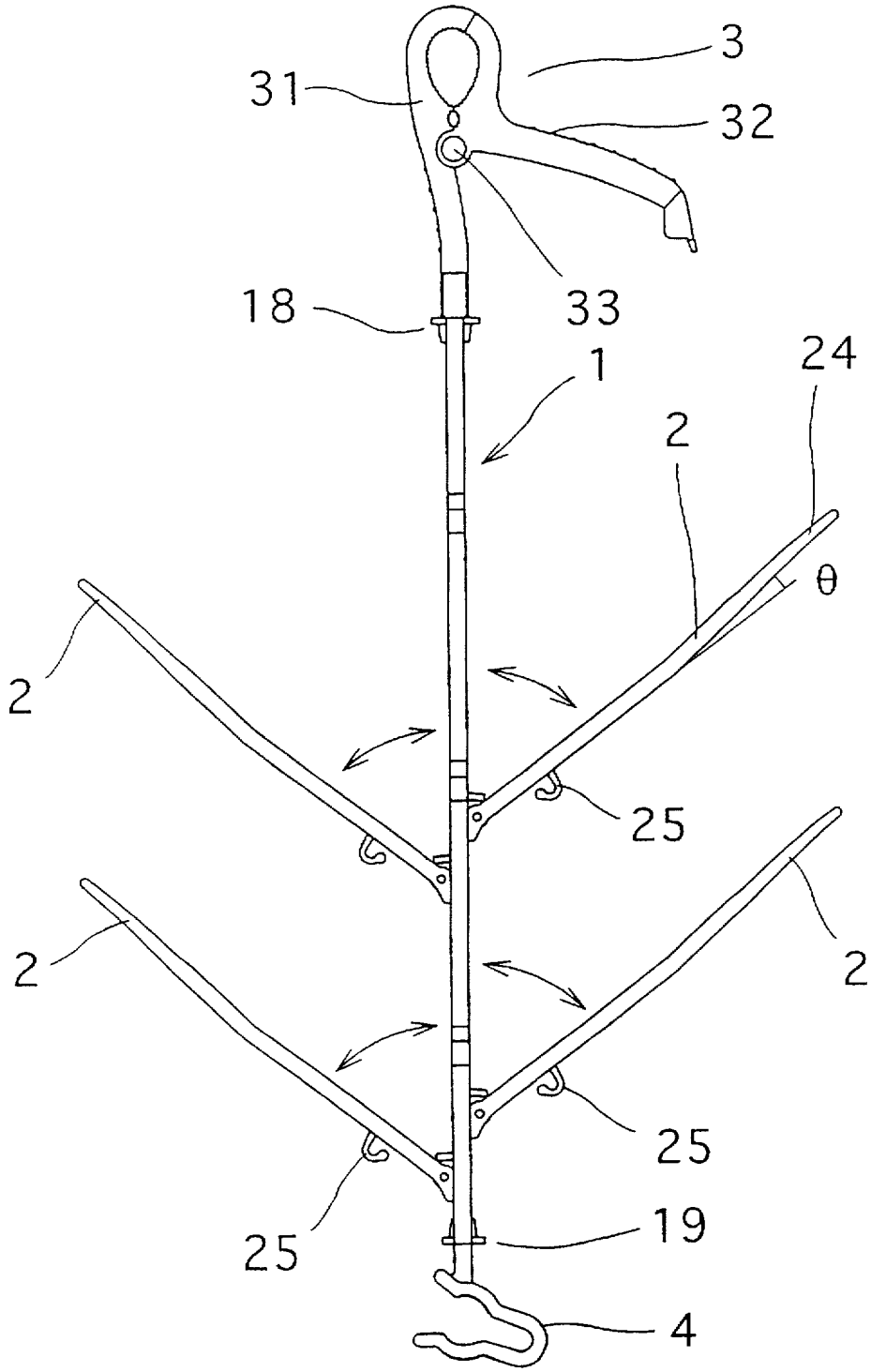
FIG. 4 is a right side view of the drying equipment of FIG. 1 in use.
Figure 5:
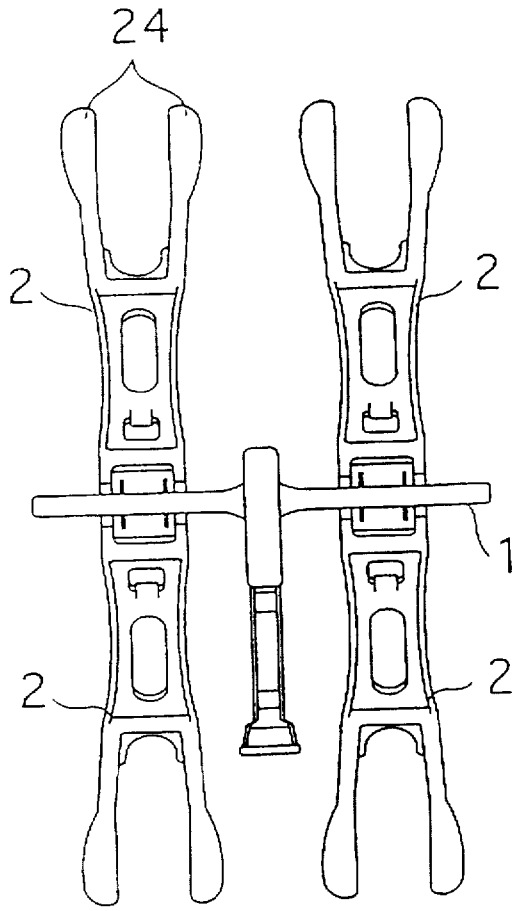
FIG. 5 is a bottom view of the drying equipment of FIG. 1 in use.
Figure 6:
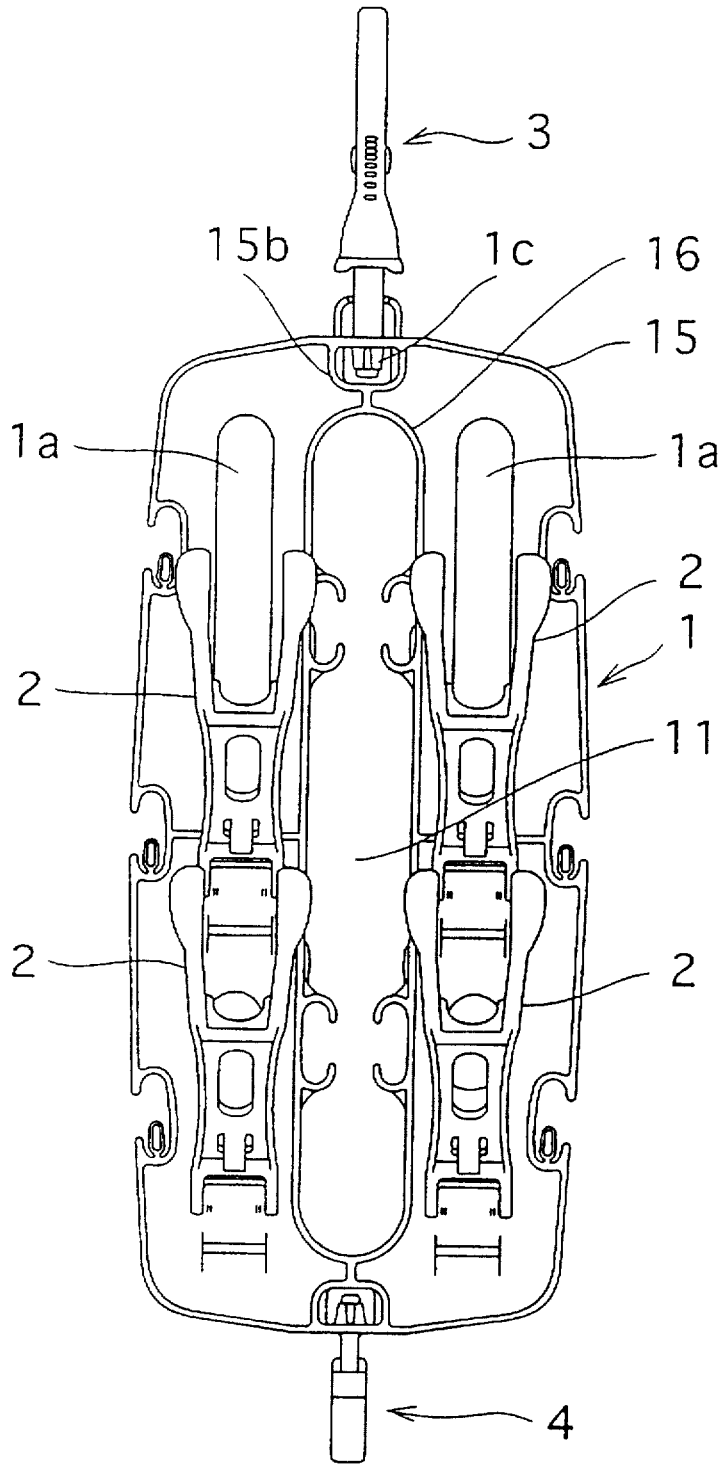
FIG. 6 is a rear side view of the drying equipment of FIG. 1 in use.
Figure 7:
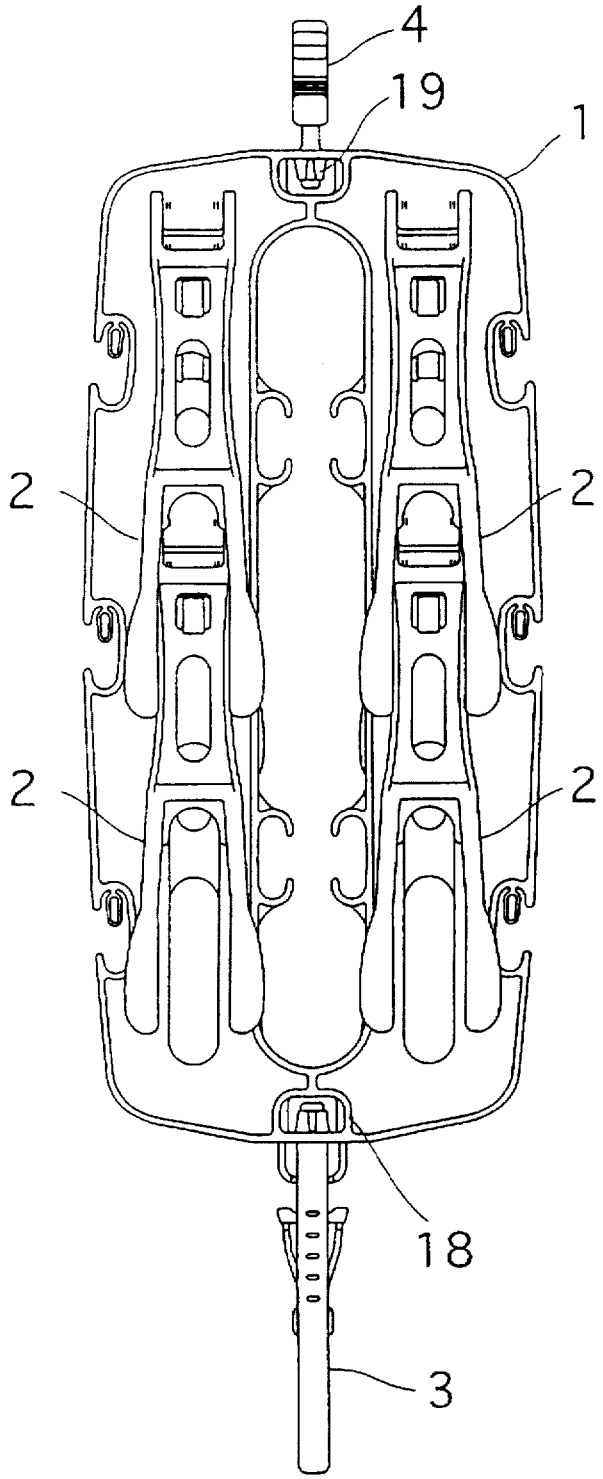
FIG. 7 is a front view of the drying equipment of this invention out of use.
Figure 8:
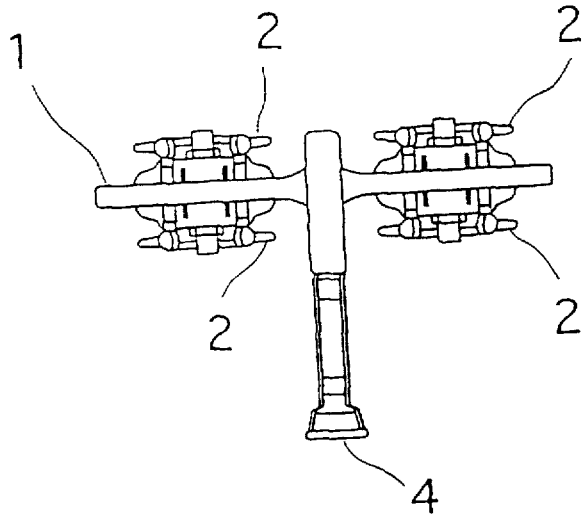
FIG. 8 is a bottom view of the drying equipment of FIG. 7 out of use.
Figure 9:
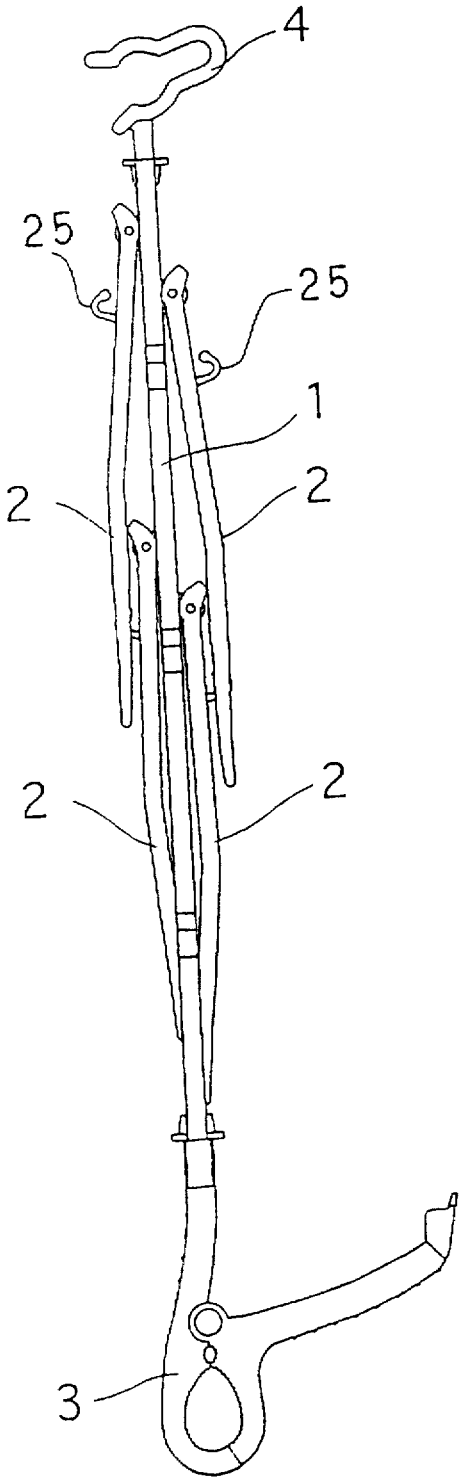
FIG. 9 is a right side view of the drying equipment of FIG. 7 out of use.
Figure 10:
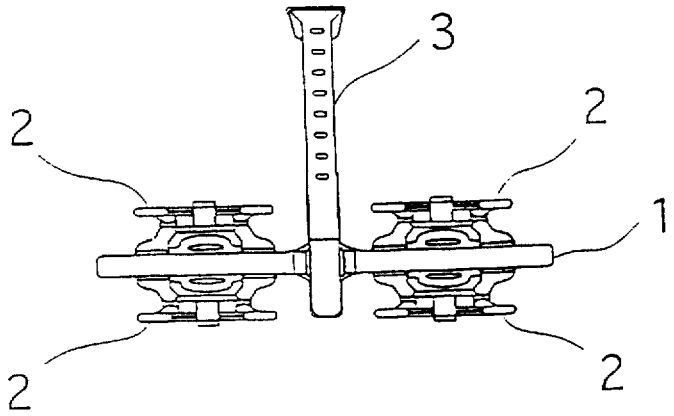
FIG. 10 is a plan view of the drying equipment of FIG. 7 out of use.
Figure 11:
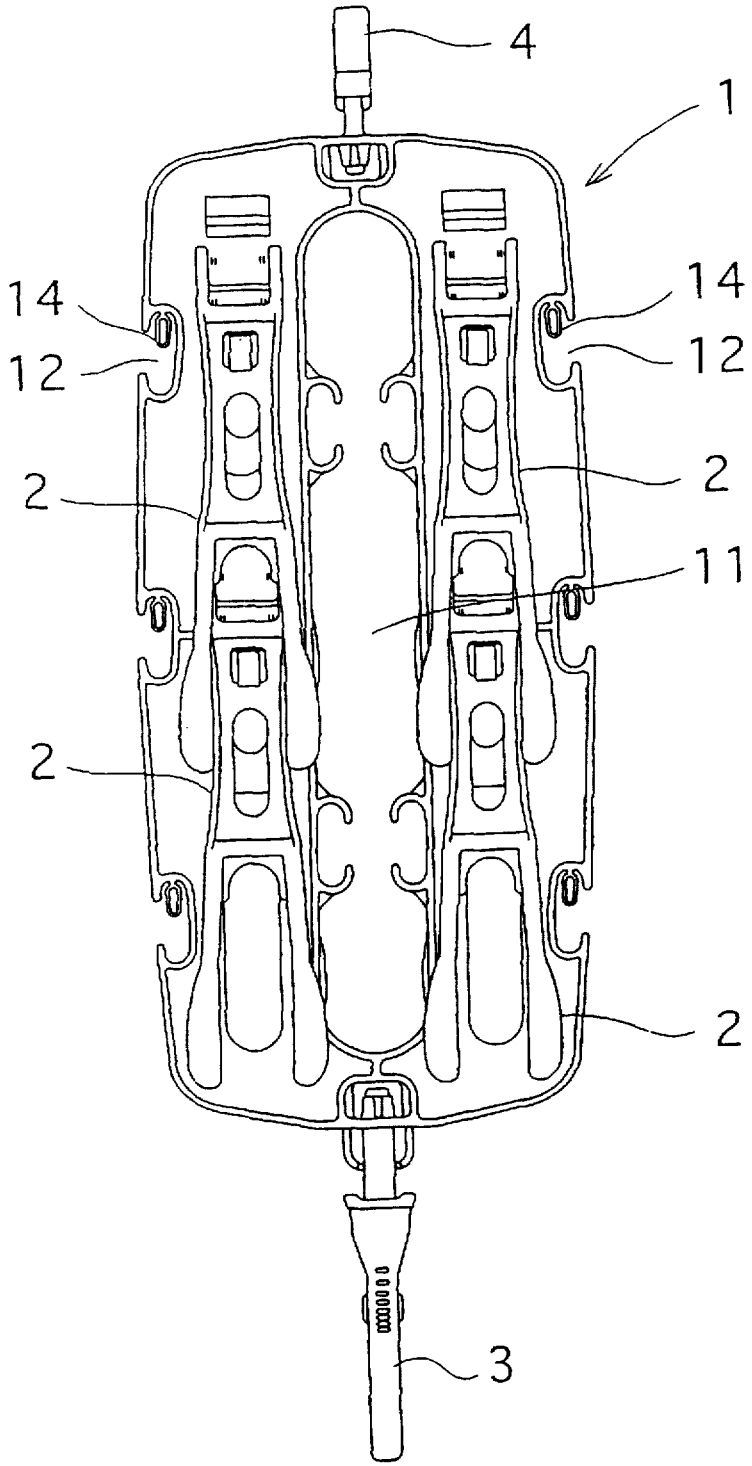
FIG. 11 is a rear side view of the drying equipment of FIG. 7 out of use.

FIG. 1 is a perspective view of drying equipment of this invention in use, FIG. 2 is a front view thereof, FIG. 3 is a plan view thereof, FIG. 4 is a right side view thereof, FIG. 5 is a bottom view thereof, FIG. 6 is a rear side view thereof, FIG. 7 is a front view of the drying equipment out of use, FIG. 8 is a bottom view thereof, FIG. 9 is a right side view thereof, FIG. 10 is a plan view thereof, and FIG. 11 is a rear side view thereof. In FIGS. 1 through 11, a reference numeral 1 denotes a body, a reference numeral 2 denotes a hanger part for hanging a shoe to be dried, a reference numeral 3 denotes a clasping part corresponding to a first suspending part used when the drying equipment is in use, and a reference numeral 4 denotes a hook corresponding to a second suspending part used when the drying equipment is out of use. All of these elements are made of a synthetic resin.

The body 1 has a longitudinally extending rectangular shape as is shown in FIGS. 1 and 2, and is provided with a space 11 for airing formed by punching a longitudinally extending elliptic hole at the center of the body 1. Furthermore, longitudinally extending elliptic holes 1*a* and 1*b* are also formed on both sides of the space 11 for airing.

The body 1 is provided, at the peripheral side portions, a plurality (three per side, namely, six in total in this embodiment) of recesses 12, each of which has a C-shape in a front view. Also, at the peripheral side portions of the space 11, a plurality (two per side, namely, four in total in this embodiment) of hitching portions 13 are formed each in a C-shape projecting into the space 11. Furthermore, each recess 12 is provided with an elliptic ring 14 at a position corresponding to the bottom of the recess 12 when the body 1 is in a regular situation for the usage of the drying equipment.

The recesses 12 and the hitching portions 13 are used for catching and drying shoe strings and other small articles, and the ring 14 is used with a string passed therethrough for hanging and drying small articles on the string.

A space between the recess 12 and the corresponding ring 14 has a function to catch a shoe string or the like so as to prevent it from slipping off.

The body 1 and the space 11 are also provided with ribs 15 and 16 at their peripheral portions for reinforcement, and the recesses 12 and the hitching portions 13 are also fringed with the ribs 15 and 16, respectively.

The front and rear faces of the body 1 are provided with plural (four per face, namely, eight in total in this embodiment) hanger parts 2 as is shown in FIG. 1. In addition, the positions of the hanger parts 2 on the front face of the body 1 are shifted from those on the rear face in the longitudinal direction by a predetermined distance.

Figure 12:
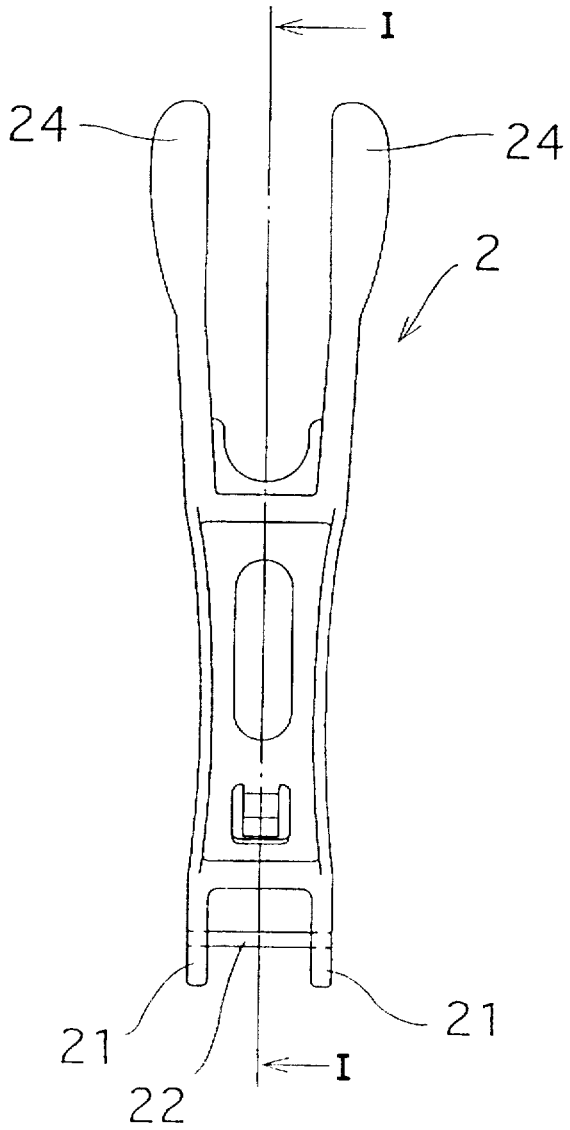
FIG. 12 is an enlarged plan view of a hanger part of the drying equipment of this invention.
Figure 13:
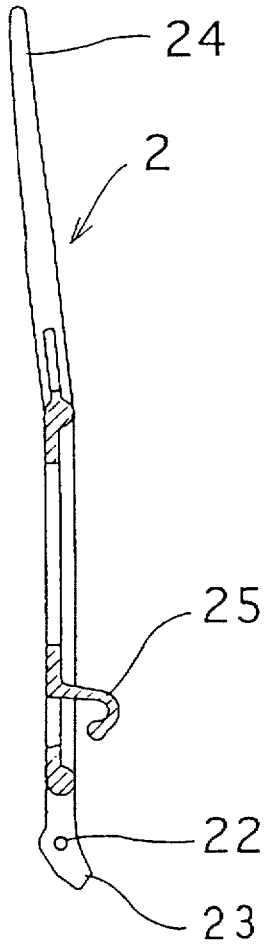
FIG. 13 is a sectional view taken along line I—I of FIG. 12.
Figure 14:
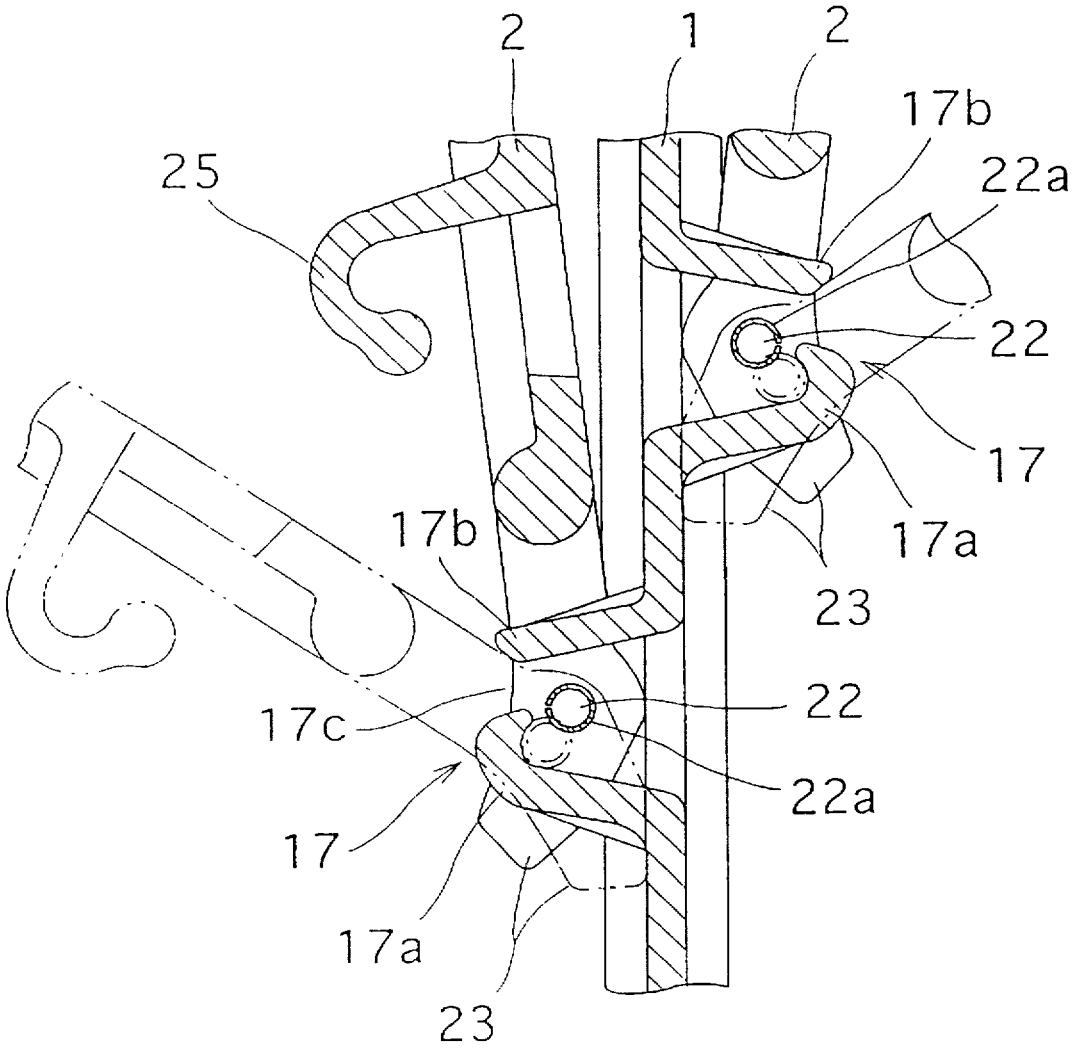
FIG. 14 is an enlarged sectional view taken along line II—II of FIG. 2.

FIG. 12 is an enlarged plan view of the hanger part 2, FIG. 13 is a sectional view taken on line I—I of FIG. 12, and FIG. 14 is an enlarged sectional view taken on line II—II of FIG. 2. The respective hanger parts 2 have substantially the same size and the same shape. As is shown in FIGS. 12 and 13, a pair of axis supporting portions 21 are disposed so as to extend from the right and left bottom portions of the hanger part 2, and an axis 22 is supported by the axis supporting portions 21. The axis 22 is caught by a bearing portion 17 disposed on the body 1 so as to be rotatable in the vertical direction as is shown in FIG. 4.

The axis 22 is covered with a metal collar 22*a* for reinforcement as is shown in FIG. 14.

Each of the axis supporting portions 21 is provided with a projection 23 at its lower end for limiting the rotation range of the hanger part 2, so that the projection 23 comes in contact with the face of the body 1 and the rotation is stopped when the hanger part 2 is rotated up to a position shown with a two-dot chain line in FIG. 14.

Each of the bearing portions 17 disposed on the body 1 includes a lower bearing piece 17*a* and an upper bearing piece 17*b* both projected forward or backward from the body 1 as is shown in FIG. 14.

The lower bearing piece 17*a* has a hook-like tip portion bent upward, by which the axis 22 of the hanger part 2 is caught. The upper bearing piece 17*b* is projected above the lower bearing piece 17*a* and has a tip portion opposing and away from the tip portion of the lower bearing 17*b* with a predetermined gap 17*c* interposed therebetween. The axis 22 of the hanger part 2 is fit in the bearing portion 17 through this gap 17*c*.

The hanger part 2 shown with a solid line in FIG. 14 is in a folded state obtained when the body 1 is hung upside down.

Furthermore, the hanger part 2 is provided with, at its tip portion, two hanger rods 24 as is shown in FIGS. 4, 12 and 13. The hanger rods 24 are in the shape of a fork widen toward the tip and tilted to be closer to the body 1 by a predetermined angle θ than the bottom portion of the hanger part 2, with the widths thereof larger and the thicknesses thereof smaller at their tips. Each hanger rod 24 catches a sneaker or the like with its bottom upside as is shown with a two-dot chain line in FIG. 1. A hook 25 is disposed to be projected backward from a lower center portion on the rear face of each hanger part 2.

The hook 25 is in a rise position not only while the drying equipment is used but also while it is not used as is shown in FIGS. 7 and 9, so that shoe strings and other small articles can be caught.

In this manner, each hanger part 2 assembled to the body 1 is rotated around the axis 22 by its own weight so as to be away from the face of the body 1 when the body 1 is hung with the clasping part 3 as is shown in FIGS. 1 and 4. The rotation of the hanger part 2 is stopped at a predetermined angle because the projection 23 comes in contact with the face of the body 1. Thus, the drying equipment is ready to be used.

When the body 1 is hung in the reverse direction with the hook 4, each of the hanger parts 2 is rotated around the axis 22 by its own weight as is shown in FIGS. 7 and 9, so as to be folded and lie along the face of the body 1.

Figure 15:
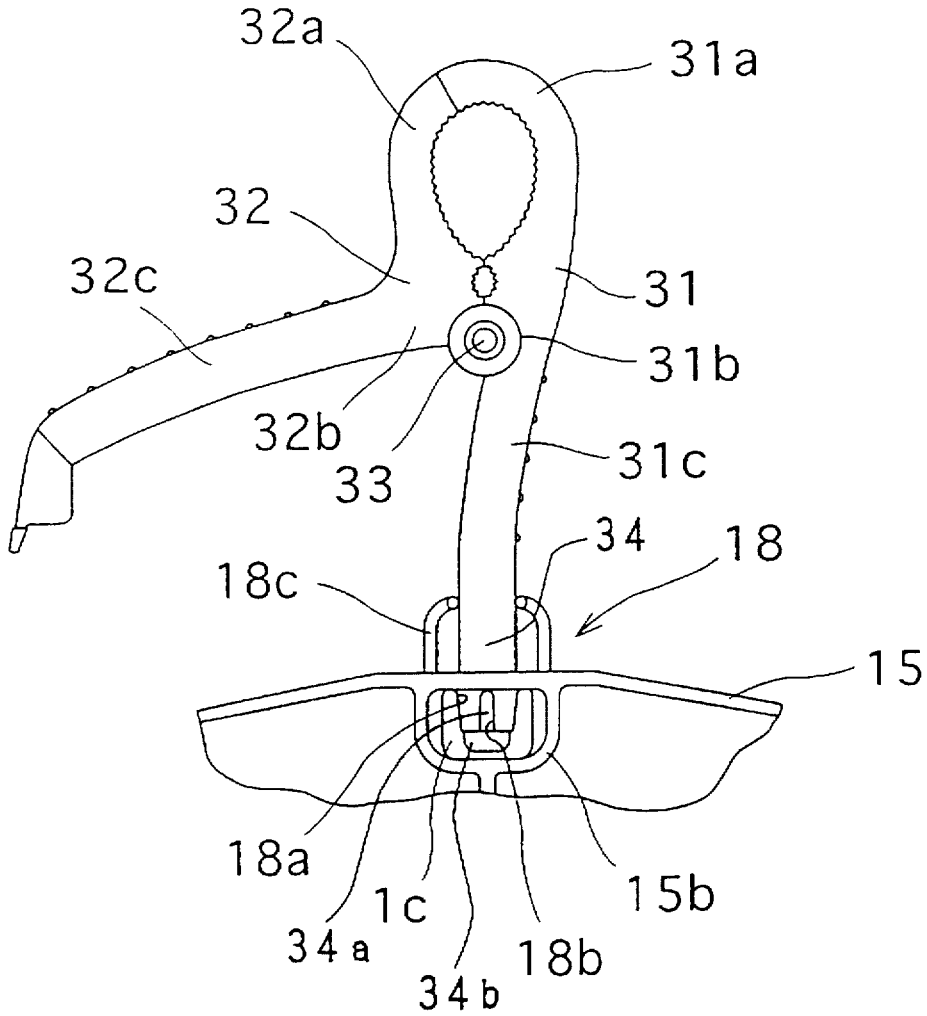
FIG. 15 is a partially enlarged view of a clasping part of the drying equipment of this invention and its mounting.

FIG. 15 is a partial enlarged view of the clasping part 3 and its mounting. The clasping part 3 includes a fixed clasping member 31, a movable clasping member 32 and an axis 33 for integrally supporting these clasping members 31 and 32.

The fixed clasping member 31 and the movable clasping member 32 respectively have clasping pieces 31*a* and 32*a*, each of which is bent at its tip portion substantially in the shape of a semi-circular arc, brackets 31*b* and 32*b* for the axis 33 at their center portions, and grips 31*c* and 32*c* at their bottom portions. The fixed clasping member 31 and the movable clasping member 32 are mutually pivoted by the axis 33 passing through the brackets 31*b* and 32*b*, and are supplied with a force by a coil spring (not shown) wound around the axis 33 in a direction for closing the clasping pieces 31*a* and 32*a*.

A mounting rod 34 in the shape of a square pillar extends from the bottom end of the grip 31*c* of the fixed clasping member 31. At the end of the mounting rod 34, a swelling portion 34*b* for preventing its coming off is disposed with a narrow portion 34*a* formed above, so that the clasping part 3 can be rotatably fit in and linked with a mounting part 18 disposed at the upper end of the body 1 through this mounting rod 34.

The mounting part 18 of the body 1 includes a downward extending fixed sleeve 18*a* with a slit 18*b*, and the fixed sleeve 18*a* is smaller than the diameter of the swelling portion 34*b* in its inner diameter, is extended from the rib 15 into a space 1*c* formed on the inner peripheral face of the rib 15 so as to be surrounded by the rib 15 and another rib 15*b* as is shown in FIG. 15. The swelling portion 34*b* of the fixed clasping member 31 is forcedly inserted into the fixed sleeve 18*a* through a hole in the rib 15. Thus, the fixed sleeve 18*a* is fit in the narrow portion 34*a* and the clasping part 3 is rotatably linked with and prevented from coming off from the mounting part 18.

A reference numeral 18*c* denotes a rotation stopping member for the clasping part 3, which is projected from the outer peripheral face of the rib 15 toward the both side surfaces of the mounting rod 34 with its tip in contact with the both side surfaces of the mounting rod 34, thereby limiting the free rotation of the clasping part 3. It is needless to say that the clasping part 3 can be forcedly rotated against the rotation stopping member 18*c*.

Figure 16:
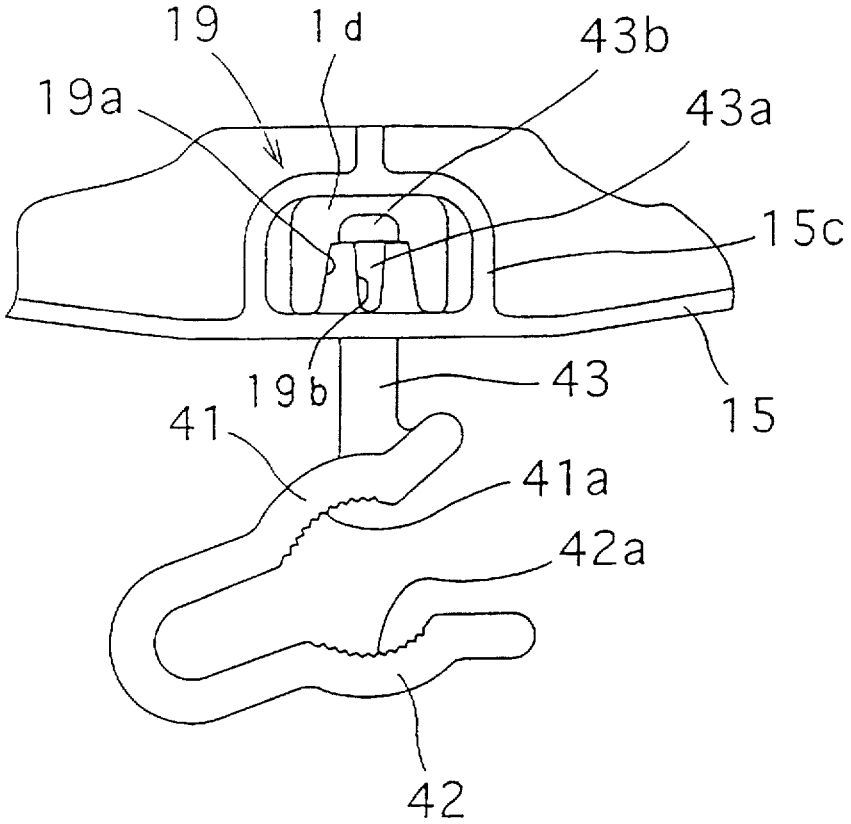
FIG. 16 is a partially enlarged view of a hook of the drying equipment of this invention and its mounting.

FIG. 16 is a partial enlarged view of the hook 4 and its mounting. The hook 4 is substantially in the shape of U with its opening faced obliquely upward, having side pieces 41 and 42 opposing each other. The side pieces 41 and 42 are respectively partly provided with arc-shaped recesses 41*a* and 42*a* on their opposing faces for grasping a clothes-drying bar or the like. Moreover, one end of a mounting rod 43 is integrally fixed on a portion near the end of the side piece 41. The other end of the mounting rod 43 is provided with a narrow portion 43*a* and a swelling portion 43*b* similar to those of the fixed clasping member 31 of the clasping part 3. Thus, the mounting rod 43 is rotatably linked with a mounting part 19, disposed at the lower end of the body 1, similar to the mounting part 18 for the clasping part 3.

Also this mounting part 19 includes a fixed sleeve 19*a*, with a slit 19*b*, which is slightly smaller than the diameter of the swelling portion 43*b* in the inner diameter and is projected from the rib 15 into a space 1*d* formed to be surrounded with the rib 15 of the body 1 and another rib 15*c*.

The fixed sleeve 19*a* is fit in the narrow portion 43*a* by forcedly inserting the swelling portion 43*b* of the mounting rod 43 into the fixed sleeve 19*a* through a hole in the rib 15. Thus, the hook 4 is rotatably linked with and is prevented from coming off from the mounting part 19.

When this drying equipment is hung with the body 1 downward by suspending the clasping part 3 on a table D (or by clasping a clothes-drying bar with the clasping part 3) as is shown in FIG. 1, the respective hanger parts 2 are rotated around the axes 22 at their bottoms by their own weights so as to be swung out in the rightward and leftward directions to be away from the body 1. Then, the projections 23 projected at their bottoms come in contact with the faces of the body 1, so as to prevent further rotation of the hanger parts 2 with each hanger part 2 inclined at the predetermined angle.

The hanger parts 2 are thus spread as is shown in FIG. 1, and sneakers and the like can be hung on the respective hanger parts 2 as is shown in FIG. 1. When the drying equipment is out of use, the clasping part 3 is taken away from the table D or the clothes-drying bar, and the hook 4 is fitted with a clothes-drying bar or the like with the body 1 upside down. Thus, the hanger parts 2 are automatically folded by their own weights so as to lie along the faces of the body 1 as is shown in FIGS. 7 and 9, and the drying equipment can be made flat.

The drying equipment can be stored with retaining this flat state.

It is noted that the numbers of the hanger parts 2, the recesses 12 and the hitching portions 13 are not herein specified but can be any number as circumstances demand.

According to the present invention, a plurality of hanger parts are rotatably disposed with the surfaces of the body, so as to be movable toward and away from the body in a range for positioning their tip portion higher than its bottom portion. Therefore, when the body is hung with a suspending part, the hanger parts are swung out to be ready for use, and when the body is hung upside down, the hanger parts are automatically folded. Thus, there is no need for breaking out and assembling operations. In addition, since the drying equipment can be made flat when the hanger parts are folded, a space for storing the drying equipment can be extremely small.

Furthermore, in the drying equipment of the invention, the hanger parts can be spread or folded by merely hanging the drying equipment in the regular situation or in the reverse situation because another suspending part is disposed at the bottom of the body. Accordingly, the drying equipment can be very simply changed with one hand from the state for use to the state out of use and vice versa.

In addition, since a plurality of hitching portions are formed on the body of the drying equipment of this invention, shoe strings and other small articles can be simultaneously hung to be dried.

Moreover, a plurality of pairs of sneakers and the like can be simultaneously dried by using the drying equipment of this invention.

Additionally, since the positions of the hanger parts of the present drying equipment are shifted in the longitudinal direction on the two faces of the body, it is so airy that the shoes can be rapidly dried.

Furthermore, the suspending part of the present drying equipment includes the fixed clasping member and the movable clasping member. Therefore, the body can be hung on a clothes-drying bar or the like by clasping it with this suspending part, and the drying equipment is prevented from being largely swung by wind or the like. Thus, the shoes on the hanger parts can be prevented from dropping off.

Moreover, the grip of the movable clasping member can be used also as a hook, the present drying equipment can be hung on a branch of a tree or an eaves when a clothes-drying bar or the like is not available.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. Drying equipment, comprising:

a body in a plate-like shape;

a plurality of hanger parts each of which is pivoted on a surface of the body at a bottom portion thereof so as to be rotated toward and away from the body in a range for positioning its tip portion higher than its bottom portion; and a suspending part disposed at a higher end of the body.

2. The drying equipment according to claim 1, wherein the body includes a plurality of hitching portions on which strings are hung.

3. The drying equipment according to claim 1, wherein the body includes another suspending part at its lower end.

4. The drying equipment according to claim 1, wherein the hanger parts are provided on two faces of the body.

5. The drying equipment according to claim 1, wherein the suspending part includes a fixed clasping member linked with the top of the body for clasping an object on which the drying equipment is hung; and a movable clasping member axially supported on the fixed clasping member.

6. The drying equipment according to claim 4, wherein positions of the hanger parts on one face of the body are vertically shifted from positions of the hanger parts on the other face.

7. The drying equipment according to claim 5, wherein each of the fixed clasping member and the movable clasping member includes a clasping portion for clasping the object and a grip used for a clasping operation, and the grip of the movable clasping member extends in a direction crossing to the grip of the fixed clasping member and works also as a hook.

* * * * *